US006874178B2

(12) United States Patent
Wall

(10) Patent No.: US 6,874,178 B2
(45) Date of Patent: Apr. 5, 2005

(54) DEVICE AT A BEDSTEAD

(75) Inventor: Jan Wall, Vemdalen (SE)

(73) Assignee: Hästens Sängar AB, Koping (SE)

( * ) Notice: Subject to any disclaimer, the term of this patent is extended or adjusted under 35 U.S.C. 154(b) by 0 days.

(21) Appl. No.: 10/297,468

(22) PCT Filed: Jun. 6, 2001

(86) PCT No.: PCT/SE01/01260

§ 371 (c)(1),
(2), (4) Date: May 7, 2003

(87) PCT Pub. No.: WO01/93725

PCT Pub. Date: Dec. 13, 2001

(65) Prior Publication Data

US 2003/0177577 A1 Sep. 25, 2003

(30) Foreign Application Priority Data

Jun. 9, 2000 (SE) ..... 0002173

(51) Int. Cl.[7] ..... A47C 20/04
(52) U.S. Cl. ..... 5/200.1; 5/617

(58) Field of Search ..... 5/200.1, 601, 617, 5/618, 634

(56) References Cited

U.S. PATENT DOCUMENTS

| | | | | |
|---|---|---|---|---|
| 4,942,633 A | * | 7/1990 | Thomas et al. | 5/11 |
| 5,586,826 A | * | 12/1996 | Kellstrom et al. | 384/450 |
| 5,774,914 A | | 7/1998 | Johnson et al. | |
| 5,829,077 A | * | 11/1998 | Neige | 5/618 |
| 5,862,549 A | | 1/1999 | Morton et al. | |
| 5,926,878 A | | 7/1999 | Morton et al. | |
| 6,358,628 B1 | * | 3/2002 | Kajikawa et al. | 428/614 |

* cited by examiner

*Primary Examiner*—Michael F. Trettel
*Assistant Examiner*—Fredrick Conley
(74) *Attorney, Agent, or Firm*—Young & Thompson

(57) ABSTRACT

A bed frame arrangement which includes a fixed outer bed frame (1) and a movable inner bed frame (2), wherein the movable inner bed frame is displaceably mounted in the outer fixed bed frame (1) through the medium of elongate slide blocks that have a surface layer of low-friction material applied to at least one side.

14 Claims, 3 Drawing Sheets

DEVICE AT A BEDSTEAD

BACKGROUND OF THE INVENTION

The present invention relates to a bed frame arrangement and then particularly to an adjustable bedstead.

The use of bedsteads that include adjustable bed frames has long been known in the art, particularly in respect of so-called hospital beds. However, in recent times the use of adjustable bed frames has also become common in the home, even bed frames that include motorised frame-orientating devices. These bed frame arrangements include a fixed outer frame and a pivotal and displaceable inner bed frame. The pivotal and displaceable inner bed frame carries raisable and lowerable back and/or leg parts and enables the back and/or leg parts of the bed to be inclined in relation to the fixed outer bed frame. In this respect, it is usual to provide a guide rail in the outer bed frame and wheels on link arms connected to the inner bed frame are adapted to roll in the guide rails to effect movement of the inner bed frame in relation to the outer bed frame. It is often so that the wheels begin to squeak or rattle after the bed has been used for some time, either due to dirt in the grooves in the guide bar or due to poor wheel bearings. Deficient or mediocre wheel bearings also make it difficult for the wheels to roll in the grooves of respective guide rails, therewith making movement of the wheels and orientation of the movable inner bed frame difficult.

SUMMARY OF THE INVENTION

Accordingly, an object of the present invention is to provide a novel bed frame arrangement which is not encumbered with the aforesaid drawbacks and which provides long-term, problem-free movement of the inner bed frame when desiring to orient the frame in relation to the fixed outer bed frame.

The object of the invention is achieved with the aid of the inventive arrangement, in which the inner bed frame is displaceably mounted in the outer bed frame through the medium of elongate slide blocks on which a surface layer or coating of low-friction material is disposed on at least one side of said frame.

According to a preferred embodiment, the slide blocks are made of a composite material on which a slide layer of polytetrafluoroethylene, Teflon®, in the form of a slide plate let into respective slide blocks.

BRIEF DESCRIPTION OF THE DRAWINGS

The invention will now be described in more detail with reference to a non-limiting embodiment illustrated in the accompanying drawings, wherein.

DETAILED DESCRIPTION OF THE PREFERRED EMBODIMENTS

Figure 1:
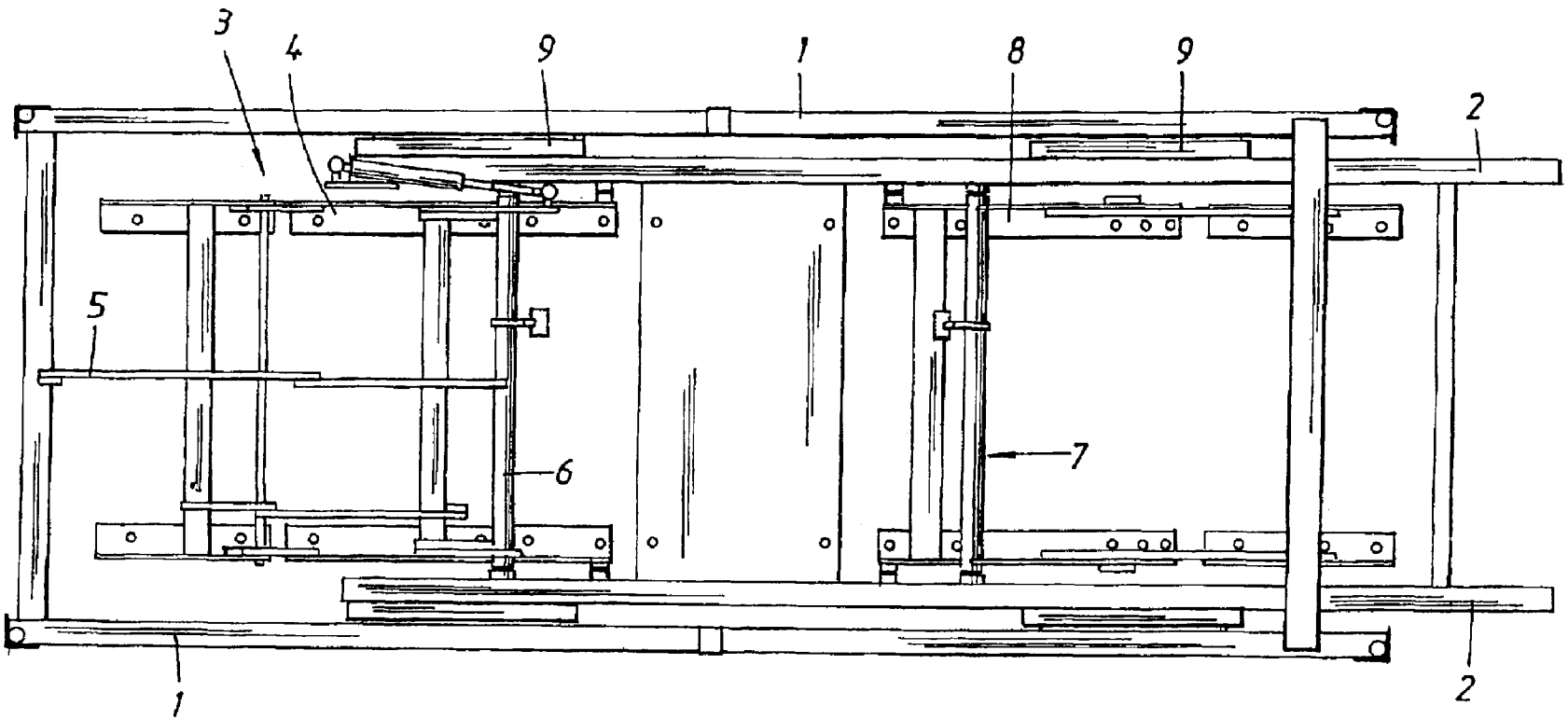
FIG. 1 illustrates a bed frame arrangement schematically from beneath.
Figure 6:
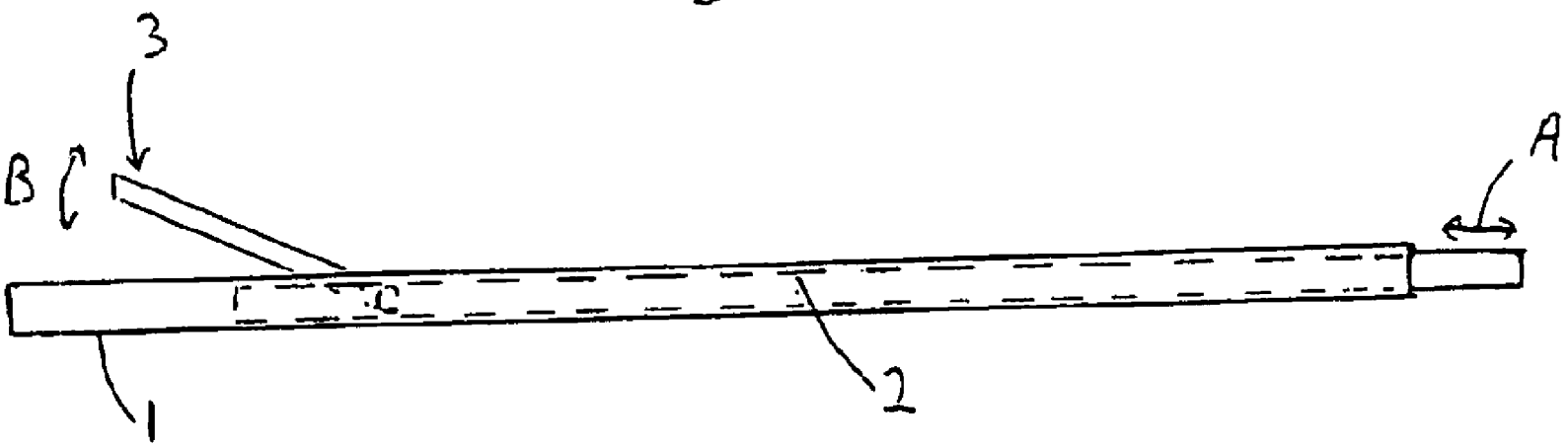
FIG. 6 is a side view of a bed frame showing part of the inner frame inclined.

As mentioned, FIG. 1 is an underside plan view of an inventive bed frame arrangement, which includes a fixed, outer frame 1 and a movable inner frame 2. Attached in the inner/movable bed frame 2 is a first mechanism 3 which includes a number of links, pivots and pivot shafts connected to fasteners 4 for a divided bed bottom (not shown) and for inclining a head-and-back part on the bed bottom. This first mechanism 3 is connected by means of a link 5 to the fixed outer frame 1 in a manner such that the head and back parts will be respectively raised and lowered as indicated by arrow B in FIG. 6 in response to commensurate displacement of the inner/movable frame 2 as indicated by arrow A in FIG. 6 in relation to the fixed outer frame 1, so that the distance of said head and back parts from the adjacent short end of the fixed outer frame 1 will always remain generally constant.

The first mechanism 3 may be typically equipped with electric setting motors for bringing the head and back parts to a desired inclined position. An arm in the link 5 is fixedly connected to a transverse pivotal shaft 6 whose ends are mounted in the movable inner frame 2. The transverse pivotal shaft 6 is also connected to pivot arms that are, in turn, connected to the attachments 4 for the head and back part of the divided bed bottom and also for connection to a drive motor (when included) for adjustment of the orientation of the head and back parts, by rotation of the shaft 6.

Also attached in the movable inner frame 2 is a second mechanism 7 which includes a number of links, pivots and pivot shafts that are connected to the attachment 8 for the divided bed bottom (not shown) and for inclining the leg and foot part of the bed bottom. The arrangement will also conveniently include a drive motor for bringing the leg and foot parts to a desired position, i.e. either a horizontal position or a position inclined upwards towards the foot end. Mounted on the outer surface of each long side of the movable inner frame 2 are generally U-shaped guide rails 9 where the open end of the U-form faces towards the opposite inner surface of the long side of the fixed outer frame 1. Mounted on the inner surface of the long side of the fixed outer frame are slide blocks 10, the free longitudinally extending surfaces of which are surrounded generally by the U-shaped guide rails on the movable inner frame 2. Two such U-shaped guide rails 9 will preferably be disposed on each side of the movable inner frame 2 in mutually spaced relationship. Consequently, two slide blocks 10 will then be disposed on each side of the fixed outer frame 1 at corresponding distances apart. The U-shaped guide rails will conveniently be made of stainless steel against which the guide blocks 10 can slide readily.

Naturally, the arrangement of the slide blocks 10 and the U-shaped guide rails 9 may be the reverse of that described above, i.e. with the slide blocks 10 mounted on the movable inner frame 2 and the guide rails 9 mounted on the fixed outer frame 1.

No link is provided on the leg part and the foot part for displacing the movable inner frame 2, since raising/inclining said part requires no adjustment of the position of the movable inner frame 2 in relation to the fixed outer frame 1.

Figure 2:
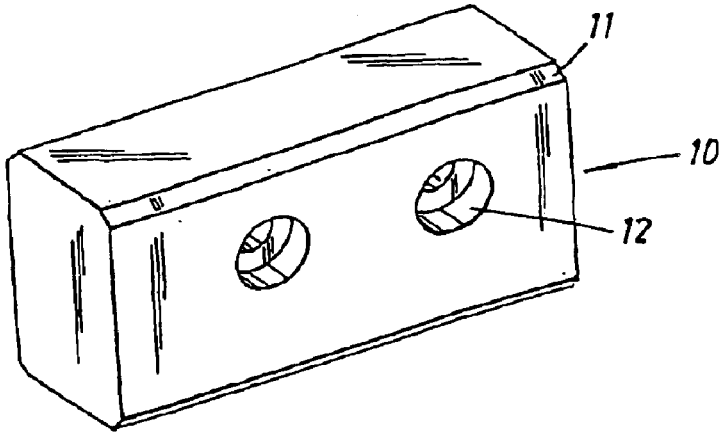
FIG. 2 illustrates schematically a slide block for use in the inventive bed frame arrangement.
Figure 3:
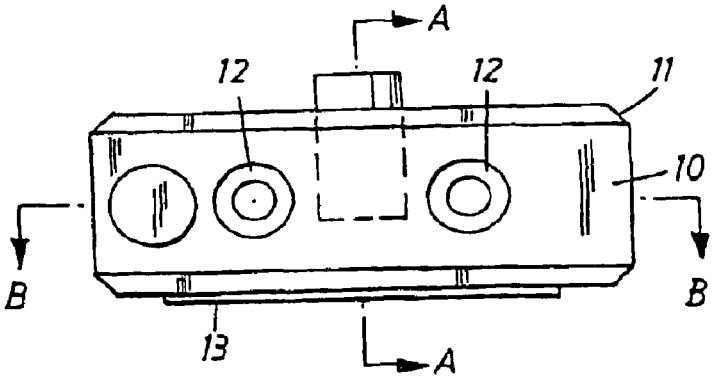
FIG. 3 is a side view illustrating a particular embodiment of a slide block.
Figure 4:
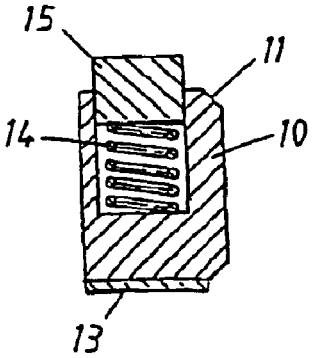
FIG. 4 is a cross-sectional view of the slide block taken on the line A—A in FIG. 3.
Figure 5:
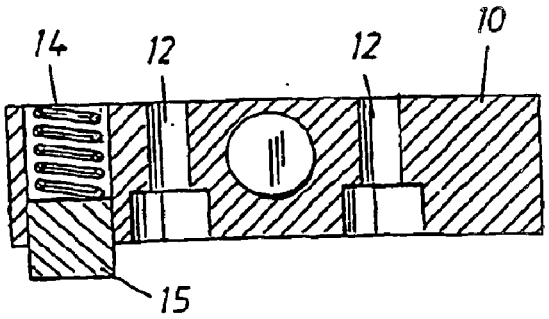
FIG. 5 is a longitudinal sectioned view of the slide block taken on the line B—B in FIG. 3.

The guide blocks 10, of which one is shown in FIG. 2, are generally in the form of elongate, rectangular bodies that have slightly bevelled longitudinal edges 11. The bodies 10 include transversally through-penetrating holes 12 that enable screw fasteners to be fastened in the inner side of the long side of the fixed outer frame 1 and therewith screw said blocks 10 firmly to said fixed outer frame 1. The blocks 10 are suitably made of a composite material, for instance from a polyamide that includes an admixture of 30% fibreglass. With the intention of reducing the friction of the blocks against the inner surfaces of the U-shaped guide rails 9, there is conveniently applied a slide layer of polytetrafluoroethylene, Teflon®, particularly a Teflon® composite, e.g. SKF POLYTETRAFLUOROETHYLENE having a friction coefficient of 0.03–0.08. The polytetrafluoroethylene slide layer suitably has the form of a slide plate 13 let into the slide block in the manner evident from FIGS. 3–5. Particles of polytetrafluoroethylene may also be integrated in the composite material.

Because the slide blocks 10 have an outer shape that fits exactly in the U-shaped guide rails 9, the blocks are able to slide in said rails without risk of binding or jamming. In order to further reduce the risk of the blocks 10 jamming or wedging in the rails 9, respective blocks are provided with holes that accommodate coil springs 14 which press inserts 15 coated with polytetrafluoroethylene against the two inner surfaces of the U-shaped guide rails 9 other than the inner surface against which the slide plate 13 is situated.

The aforesaid preferred slide block material means that the risk of binding is minimal and that the conditions for problem-free functioning of the slide blocks is far better than in the case of wheels or rollers that move in grooves, as in the case of hitherto known arrangements.

The aforementioned divided bed bottom may be of any type whatsoever of the various types that are commercially available at present. However, an interior sprung mattress is preferred.

What is claimed is:

1. A bed frame arrangement which includes a fixed outer frame and a movable inner frame, wherein the movable inner frame is displaceably mounted in the outer fixed frame through elongate slide blocks on which a surface layer of low-friction material has been applied on at least one side of said blocks, wherein the inner bed frame includes at least one part that can be adjusted to an inclined position, wherein the inner bed frame includes a head and a back part that can be oriented as desired, and wherein a pivot shaft, which is rotated by the inner movable bed frame when changing the inclined position of the head and back part, is connected to a link for automatic displacement of the inner movable bed frame in relation to the fixed bed frame.

2. A bed frame arrangement which includes a fixed outer frame and a movable inner frame, wherein the movable inner frame is displaceably mounted in the outer fixed frame through elongate slide blocks on which a surface layer of low-friction material has been applied on at least one side of said blocks, wherein the slide blocks are made of a composite material, and wherein the composite material has applied thereon a slide layer of polytetrafluoroethylene in the form of a slide plate let into the slide block.

3. A bed frame arrangement which includes a fixed outer frame and a movable inner frame, wherein the movable inner frame is displaceably mounted in the outer fixed frame through elongate slide blocks on which a surface layer of low-friction material has been applied on at least one side of said blocks, wherein the slide blocks are mounted on either the outer fixed bed frame or the movable inner bed frame and are adapted to slide in U-shaped guide rails provided on the other of said outer fixed frame or the movable inner frame, wherein the U-shaped guide rails closely surround the guide blocks, and wherein the slide blocks include pressure springs that carry support inserts which are coated with polytetrafluoroethylene, said springs functioning to press the inserts against at least one inner surface of the U-shaped guide rail embracing said slide block.

4. A bed frame arrangement according to claim 3, characterized in that the U-shaped guide rails (9) are made of stainless steel.

5. A bed frame arrangement comprising:

a fixed outer frame having a first end;

a movable inner frame;

a plurality of elongate slide blocks connected to one of said inner and outer frames so that said inner frame is displaceably mounted within said fixed outer frame via said plural elongate slide blocks, said plural elongate slide blocks comprising at least one low friction surface; and an adjustable device connected between said inner and outer frames having a distal end that is structured and arranged to move from an initial position substantially in a plane of said fixed outer frame, to an inclined position outside of said plane of said fixed outer frame, wherein a distance between said first end and said distal end is substantially constant regardless of an amount of inclination of said distal end.

6. The bed frame arrangement as claimed in claim 5, wherein said adjustable device comprises a transverse member pivotally connected to said inner frame.

7. The bed frame arrangement as claimed in claim 6, wherein said adjustable device comprises a linking member connected between said transverse member and said outer frame.

8. The bed arrangement according to claim 5, further comprising another adjustable device connected to said inner frame at a second end opposite said first end and that is structured and arranged to move from an initial position substantially in a plane of said fixed outer frame, to an inclined position outside of said plane of said fixed outer frame.

9. The bed arrangement according to claim 5, wherein the plural slide blocks are made of a composite material.

10. The bed arrangement according to claim 9, wherein the composite material comprises a slide layer of polytetrafluoroethylene.

11. The bed arrangement according to claim 5, further comprising a plurality of U-shaped guide rails on the other one of said inner and outer frames, said plural elongate slide blocks slidably engaging respective ones of said plural U-shaped guide rails.

12. The bed arrangement according to claim 11, wherein the plural U-shaped guide rails substantially surround respective ones of said plural slide blocks.

13. The bed arrangement according to claim 12, wherein the plural slide blocks include pressure springs each having at least one support insert which is coated with polytetrafluoroethylene, said springs press a respective insert against at least one inner surface of a respective U-shaped guide rail.

14. The bed arrangement according to claims 11, wherein the plural U-shaped guide rails are made of stainless steel.

* * * * *